US006237521B1

(12) United States Patent
Müller

(10) Patent No.: US 6,237,521 B1
(45) Date of Patent: May 29, 2001

(54) SAILCLOTH ARRANGEMENT FOR SAILS OF WATER-GOING VESSELS

(76) Inventor: Hermann-Frank Müller, Lyngsbergstrasse 3a, D-53177, Bonn (Bad Godesberg) (DE)

( * ) Notice: Subject to any disclaimer, the term of this patent is extended or adjusted under 35 U.S.C. 154(b) by 0 days.

(21) Appl. No.: 09/489,416

(22) Filed: Jan. 21, 2000

(30) Foreign Application Priority Data

Jan. 21, 1999 (DE) ..... 199 02 012

(51) Int. Cl.[7] ..... B63H 9/04

(52) U.S. Cl. ..... 114/102.29; 114/39.21; 114/102.33; 440/1; 440/6; 440/8

(58) Field of Search ..... 114/39.21, 102.29, 114/102.33; 440/6, 1, 113, 8

(56) References Cited

U.S. PATENT DOCUMENTS

Re. 31,156 * 2/1983 Dessert ..... 180/2 A
5,131,341 7/1992 Newman .
5,477,424 * 12/1995 Mocha ..... 362/32
5,736,954 * 4/1998 Veazey ..... 342/8
5,779,348 * 7/1998 Interlicchio ..... 362/108
5,863,228 * 1/1999 Tether ..... 440/6

FOREIGN PATENT DOCUMENTS

3836259A1 4/1989 (DE) .
4105318A1 8/1991 (DE) .

OTHER PUBLICATIONS

De Yacht Article 18/92.

* cited by examiner

*Primary Examiner*—S. Joseph Morano
*Assistant Examiner*—Lars A. Olson
(74) *Attorney, Agent, or Firm*—Robert W. Becker & Associates

(57) ABSTRACT

A sailcloth arrangement for a sail of a water-going vessel has a sailcloth base and flexible solar cells attached to the sailcloth base. The flexible solar cells have a flexibility matching the flexibility of the sailcloth, and the flexible solar cells are configured to be connected to at least one energy storage device.

13 Claims, 1 Drawing Sheet

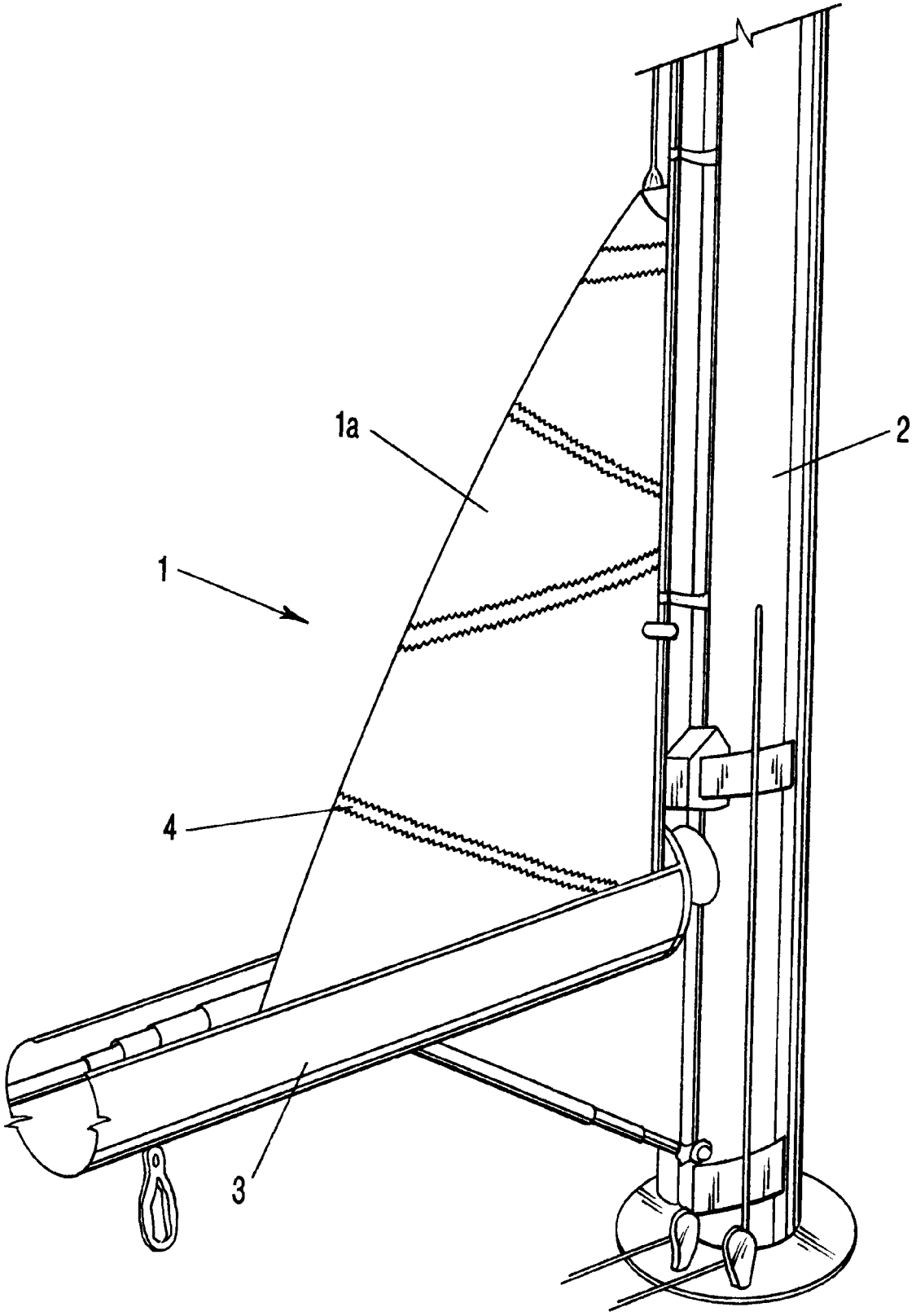
1a
2
1
4
3

SAILCLOTH ARRANGEMENT FOR SAILS OF WATER-GOING VESSELS

BACKGROUND OF THE INVENTION

Even though the era of sail ships is in general over, sailing is still a popular hobby in the warm temperature seasons. Furthermore, the training of sailors includes journeys on schooling ships. Furthermore, sailboats, especially in East Asia, still provide inexpensive transportation of goods. Over the centuries, the technology for producing sailcloth has been improved constantly in order to take into account the growing demands with regard to stability against tensile forces and pressure as well as moisture, aging resistance, impermeability to wind, rolling behavior, and weight reduction per square meter.

Energy is required on a sailboat for different purposes. In particular, without wind the best sail cannot do anything against the practically stationary bobbing on the sea. Also for this very reason, sailboats have in general an auxiliary engine with which they can approach the mooring in a harbor and can also maneuver within the harbor independently of the wind conditions. Such an auxiliary motor is usually actuated by a generator which for energy production requires gasoline or diesel fuel. This results in noise emission as well as pollutant emission and increased operating cost.

It is therefore an object of the present invention to provide a measure to reduce the operating cost as well as to lower the noise emission and pollutant emission at least when people are in the surroundings of the sailboat.

SUMMARY OF THE INVENTION

As a solution to this object the use of flexible solar cells is suggested which are embodied and mounted on the sailcloth such that their flexibility corresponds to the flexibility of the sailcloth and such that the solar cells are connected to at least one energy storage device to thus store the produced energy and, when needed, to supply it to a consuming device.

Advantageous details of the arrangement of the solar cells, their connection to the sailcloth as well as the conduction of the produced energy are disclosed in the following description

BRIEF DESCRIPTION OF THE DRAWINGS

The inventive sailcloth arrangement will be explained in more detail with the aid of the only drawing showing a partially rolled-up sailcloth comprised of several sailcloth portions which are connected to diagonally or slantedly arranged supports in a fixed manner on which non-represented flexible solar cells or solar cell strips are detachably mounted.

DESCRIPTION OF PREFERRED EMBODIMENTS

Depending on the size and application, a sail 1 can be comprised of one or several sailcloth portions 1 a which are fixedly connected to one another. The sail is mounted on a mast 2 and a boom 3 provided for pivoting the sail 1 about the mast 2. According to the drawing, the sail can be e.g. rolled up within the boom. However, there are other well-known variations for reefing and storing a sail.

Independent of the type and design of the sail, it can be used for energy production when flexible solar cells are individually mounted or mounted in rows mounted on the sailcloth base. The solar cells or solar cell strips can be arranged in horizontal, vertical, or diagonal rows. It lies within the discretion of the engineer, given the desired application, how many solar cells are to be mounted on the sailcloth base. A greater number of solar cells increases the output of energy, but also increases the weight of the sailcloth arrangement and thus the total weight of the water-going vessel that is to be moved by the force of wind with the aid of the surface area of the sail.

The solar cells are flexible so that they can be rolled up together with the sailcloth portions 1*a*. However, solar cells cannot expand when exposed to wind forces in the same manner as the sailcloth itself. Therefore, the designer and engineer must position the solar cells on the sailcloth base comprised of the sailcloth portions 1*a* such that the expansion differential can be compensated, for example, by the arrangement of slotted holes in which fastening bolts can glide, by rail guiding system, etc., i.e., well-known measures from the prior art. The location of attachment elements must also be taken into consideration since in the vicinity of the sailcloth edges the expansion of the sailcloth is, of course, smaller.

The energy produced by the solar cells is carried by correlated electrical lines to at least one (non-represented) energy storage device. The electrical lines are protected against the elements, especially against moisture in its many variations and against wind up to a predetermined maximum wind velocity. For example, the electrical lines can be arranged in gaps between the solar cells. The at least one energy storage device should expediently be mounted on or within the boom or mast to which the sailcloth arrangement 1 with its solar cells is attached and should also be protected against the elements. Of course, it is also possible to position the energy storage device at any other location on the ship, for example, on deck. This requires longer electrical lines extending from the solar cells. The energy storage device can be a high-performance capacitor. A plug-in for plugging in consuming devices should be provided in the vicinity of the energy storage device so as to shorten the required electrical cable length. This has furthermore the advantage of protecting the energy storage device against the elements.

When the flexible solar cells are provided as strips, e.g. positioned between two sailcloth portions 1*a,* they can be fixedly (non-detachably) connected to these sailcloth portions wherein it should be taken into consideration that the fastening elements must withstand the wind force as well as the expansion differential. When the flexible solar cell strips are mounted on a flexible support 4, having an expansion behavior corresponding to that of the sailcloth base 1, then this support 4 should be non-detachably connected to the neighboring sailcloth portions 1*a*. The solar cells or solar cell strips, on the other hand, should be detachable from the support 4 but should be connected in a water tight and wind tight manner to the support. In this manner, the integrity of the sail 1 is always maintained, with only the solar cells being removable.

When the flexible support 4 for the solar cells or solar cell strips is transparent, a maximum energy production can be realized since sunlight impinges from both sides onto the solar cells, which improves the efficiency.

In addition to using the solar energy for the daily energy needs on a ship, for example, for actuating a winch, the anchor, or the systems for setting sail and reefing it, optionally for operating an auxiliary motor, the solar energy can also be used for advertising purposes, for example, by providing illuminated surfaces on the sailcloth. This can also be accomplished by employing light-producing foils. These foils can also serve optionally as emergency lights and positioning lights in fog.

The present invention is, of course, in no way restricted to the specific disclosure of the specification and drawings, but also encompasses any modifications within the scope of the appended claims.

What is claimed is:

1. A sailcloth arrangement for a sail of a water-going vessel, said sailcloth comprising:

a sailcloth base;

flexible solar cells attached to said sailcloth base;

said flexible solar cells being configured to be connected to at least one energy storage device;

wherein said flexible solar cells have a flexibility matching a flexibility of said sailcloth; and wherein said flexible solar cells are attached such that an expansion of said sailcloth base by a force of wind acting on said sailcloth is not impaired.

2. A sailcloth arrangement according to claim 1, wherein said flexible solar cells are strips arranged in a longitudinal direction or a transverse direction of said sailcloth base and are connected undetachably to neighboring portions of said sailcloth base.

3. A sailcloth arrangement according to claim 1, wherein said flexible solar cells are strips arranged in a diagonal direction of said sailcloth base and are connected undetachably to neighboring portions of said sailcloth base.

4. A sailcloth arrangement according to claim 1, wherein said flexible solar cells are spaced apart so that portions of said sailcloth between neighboring ones of said flexible solar cells allow expansion of said sailcloth under a force of wind acting on said sailcloth arrangement independent of a position of said flexible solar cells.

5. A sailcloth arrangement according to claim 1, wherein between said solar cells gaps are defined and wherein electrical lines are mounted in said gaps and are configured to carry electrical energy produced by said solar cells to said at least one energy storage device.

6. A sailcloth arrangement according to claim 5, wherein said electrical lines are designed and mounted such that they are protected against the elements.

7. A sailcloth arrangement according to claim 1, configured to be mounted on a mast or boom of the water-going vessel, wherein said at least one energy storage device comprises at least one high-performance capacitor configured to be mounted on said mast or said boom and protected against the elements.

8. A sailcloth arrangement according to claim 1, comprising at least one electrical plug-in allowing transfer of the electrical energy stored in the electrical storage device to an electrical consuming device.

9. A sailcloth arrangement according to claim 1, further comprising at least one flexible support, wherein said solar cells are mounted on said at least one flexible support, wherein said at least one flexible support has expansion properties matching expansion properties of said sailcloth base at least to such an extent that an expansion of said sailcloth base by a force of wind acting on said sailcloth base is not impaired, wherein said at least one flexible support is fixedly connected to neighboring portions of said sailcloth base.

10. A sailcloth arrangement according to claim 9, wherein said at least one flexible support is transparent.

11. A sailcloth arrangement according to claim 9, wherein said solar cells are detachably but water-tightly and wind-tightly fastened to said at least one flexible support.

12. A sailcloth arrangement according to claim 1, comprising electrically illuminated surface areas.

13. A sailcloth arrangement according to claim 12, comprising light-producing foils for electrically illuminating said surface areas, wherein said foils receive electrical energy from said at least one electrical storage device.

* * * * *